US010214332B2

(12) United States Patent
Eyal

(10) Patent No.: US 10,214,332 B2
(45) Date of Patent: Feb. 26, 2019

(54) BEVERAGE CONTAINER CAP HOLDER

(71) Applicant: CALIDRATION, INC., Oxnard, CA (US)

(72) Inventor: Sharon Eyal, Oxnard, CA (US)

(73) Assignee: CALIDRATION, INC., Oxnard, CA (US)

( * ) Notice: Subject to any disclaimer, the term of this patent is extended or adjusted under 35 U.S.C. 154(b) by 30 days.

(21) Appl. No.: 15/647,130

(22) Filed: Jul. 11, 2017

(65) Prior Publication Data

US 2018/0029762 A1 Feb. 1, 2018

Related U.S. Application Data

(60) Provisional application No. 62/367,893, filed on Jul. 28, 2016.

(51) Int. Cl.
*B65D 55/16* (2006.01)

(52) U.S. Cl.
CPC ..... *B65D 55/16* (2013.01)

(58) Field of Classification Search
CPC ..... B65D 55/16
USPC ..... 220/375; 215/306
See application file for complete search history.

(56) References Cited

U.S. PATENT DOCUMENTS 1,924,242 A * 8/1933 Kaye ..... B65D 55/16 215/306
3,306,483 A * 2/1967 Bellafiore ..... B65D 35/42 215/306
5,150,808 A * 9/1992 Hamilton ..... B60K 15/0406 220/255
5,178,308 A * 1/1993 Endre ..... B62J 11/00 215/306
D342,449 S * 12/1993 Mattheis ..... D9/446
5,593,054 A * 1/1997 Glynn ..... B65D 50/062 215/206
5,730,292 A * 3/1998 Jones ..... B01L 3/50825 206/459.5
6,588,622 B1 * 7/2003 Leishman ..... B65D 23/00 215/306
7,040,499 B1 * 5/2006 Reif ..... B65D 41/08 215/235
8,752,720 B1 * 6/2014 Habig ..... B65D 55/16 215/306
9,493,283 B2 * 11/2016 Tuyn ..... B65D 55/16
2006/0124644 A1 * 6/2006 Dehn ..... B60K 15/0406 220/259.3
2008/0029557 A1 * 2/2008 Moran ..... B65D 47/244 222/543
2008/0314933 A1 * 12/2008 Leonoff ..... B65D 23/00 222/215
2009/0134112 A1 * 5/2009 Reeves ..... A61J 11/008 215/11.6
2015/0251795 A1 * 9/2015 Tsui ..... A45C 7/0031 215/306

(Continued)

*Primary Examiner* — Kareen K Thomas

(57) ABSTRACT

An elastomeric cap is fitted to the removable closure of a beverage container or bottle. A tether is fastened to the cap with a small loop that readily swivels. At the other end of the tether is a larger loop which can fit around the neck of the container or bottle. The tether restrains the closure when it is removed from the container thereby minimizing the likelihood of loss of the closure. The cap can be separated from the tether and replaced by a cap of different color or with decorative graphics.

7 Claims, 4 Drawing Sheets

(56) References Cited

U.S. PATENT DOCUMENTS

2016/0159538 A1* 6/2016 Michie ..... A45F 3/16
215/306

* cited by examiner

BEVERAGE CONTAINER CAP HOLDER

BACKGROUND OF THE INVENTION

1. Field of the Invention:

This invention relates to drinkware and, more particularly, apparatus for tethering a removable cap to a beverage container such as a bottle.

2. General Background and State of the Art:

A recurring problem with bottles used for hydration and which contain water or other beverages, is that unless the bottle cap is hingedly fastened to the bottle, it is easily misplaced or lost. This problem is not unique to beverage containers. Similar problems can exist with fuel caps for motor vehicles and a solution was suggested in U.S. Pat. No. 5,150,808 to Tyrone Hamilton, which issued Sep. 29, 1992.

As early as 1894, there was concern that a stopper or cap for a bottle could be misplaced or lost and a patent to T. B. Birnbaum, U.S. Pat. No. 524,159 issued Aug. 7, 1894 disclosed a rubber "Stopper or Cover For The Mouth of Bottles" which included a tether with an elastic ring that encompassed the bottle neck and was attached to the cap or stopper. A design patent to Harley H. Mattheis, Pat. No. Des. 342,449, issued Dec. 21, 1993 shows a cap attached to a container with a lanyard.

INVENTION SUMMARY

In the intervening almost 25 years since Hamilton, there has been nothing similar provided for water bottles. What is needed, and what is provided in the present invention, is an elastomeric cover for a removable bottle cap or cover which can be fitted with a lanyard or tether that can be attached to the bottle. According to a preferred embodiment of the present invention, the lanyard or tether includes a loop which is fastened to the bottle and is attached at the other end by a swivel mount to a disc which can be inserted into an elastomeric cap cover. This feature permits the provision of cap covers of various colors or bearing decorative designs which can be interchanged to suit the mood of the user The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

BRIEF DESCRIPTION OF THE DRAWINGS

FIG. 4, including

FIG. 6 including

DETAILED DESCRIPTION OF THE PREFERRED EMBODIMENTS

Figure 1:
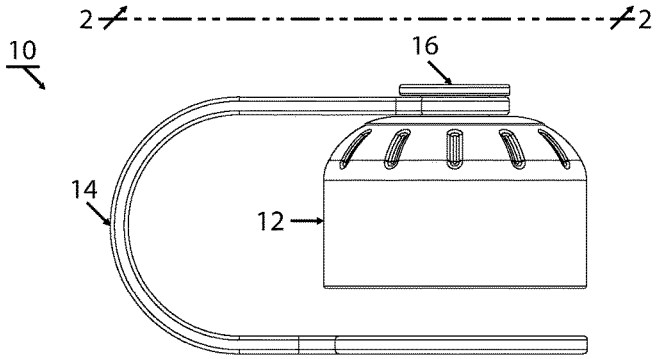
FIG. 1 is a side view of a tethered cap according to the present invention.

Turning first to FIG. 1, there is shown a cap holder in the form of a tethered cap 10 according to a preferred embodiment of the present invention. The tethered cap 10 includes a cap element 12, preferably made of a resilient elastomer, a tether 14 and a tether capture assembly 16, preferably made of a material that can provide a low friction coupling as between the tether 14 and the capture assembly 16 so that the tether 14 is freely rotatable about the capture assembly 16

Figure 2:
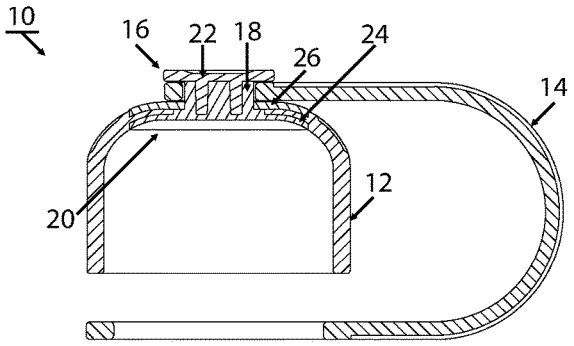
FIG. 2 is a sectional view of the cap of FIG. 1 along the lines 2-2 in the direction of the appended arrows.
Figure 3:
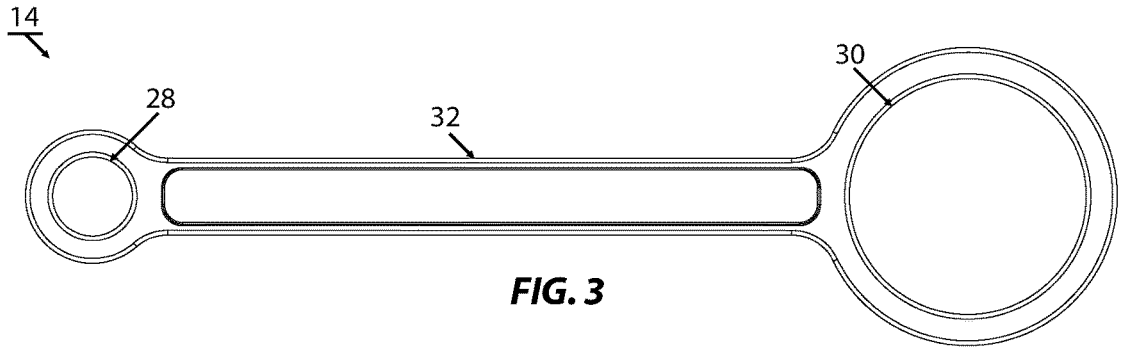
FIG. 3 is a top plan view of the tether element of the present invention according to a preferred embodiment.

In FIG. 2, the components of the tethered cap 10 can be seen in greater detail. As shown, the tether 14 rotates about a post portion 18 of a lower capture element 20 of the capture assembly 16 and is held in place by rivet like top element 22. The cap element 12 is held between the lower capture disc element 24 of the capture assembly 16 and the upper capture disc element 26, The tether 14 is shown in plan view in FIG. 3. As seen, the tether 14 includes a small loop 28 which is coupled to the cap 10 and a larger loop 30 which is adapted to fit around the neck of the container to which the cap 12 belongs. In the preferred embodiment, the tether 14 is made of a flexible but durable plastic material and can be same material from which the tether capture assembly 16 is comprised.

The loops 28, 30 are at opposite ends of a connector 32 which can be thin and sufficiently flexible to bend upon itself so that the loops 28, 30 can be coaxial. Identifying indicia can be printed, stamped, engraved or otherwise applied to the connector 32. Alternatively, decorative designs can be applied to one or both surfaces. In some embodiments, the connector 32 may have a u-shaped resting configuration where the cap 12 and the bottle top which it encompasses remain positioned over the bottle mouth.

Figure 4A:
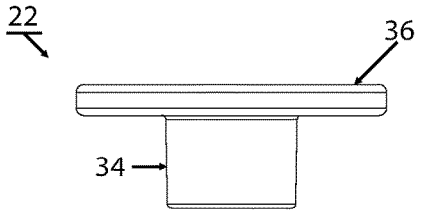
FIGS. 4A and 4B is a side view and a sectional view, respectively, of a top element according to a preferred embodiment.
Figure 4B:
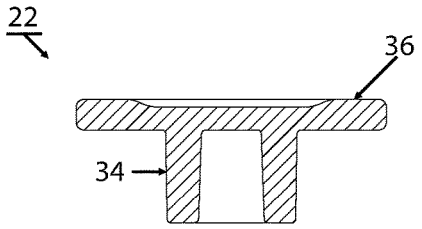

FIG. 4 provides a better view of the structure of the top element 22. Its primary function is to attach the small loop 28 of the tether 14 to the cap 12. For that purpose, the top element has a hollow cylindrical body 34 with a diameter much less than the diameter of the small loop 28. The cylindrical body 34 terminates at its upper end in a disk 36 with a diameter greater than the diameter of the small loop 28, thereby retaining the small loop 28 in place while permitting relative rotation as between the tether 14 and the capture assembly 16. These features are evident in the plan view of FIG. 4A and the sectional view of FIG. 4B.

Figure 5:
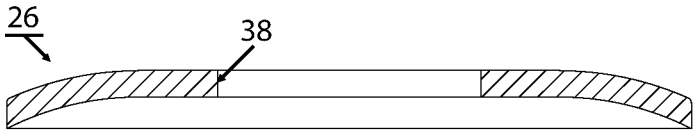
FIG. 5 is side section view of an upper capture disc.

In FIG. 5, there is shown an upper capture disc 26 which has a central aperture 38 sized to fit the base element of the tether capture assembly 16, which is more fully described in connection with FIG. 6. The upper capture disc 26 cooperates with the lower capture disc 24 (shown in FIG. 6) to hold the cap 12.

Figure 6A:
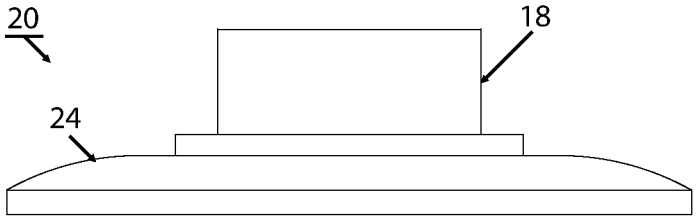
FIGS. 6A and 6B is a side view and a sectional view, respectively, of a lower capture element.
Figure 6B:
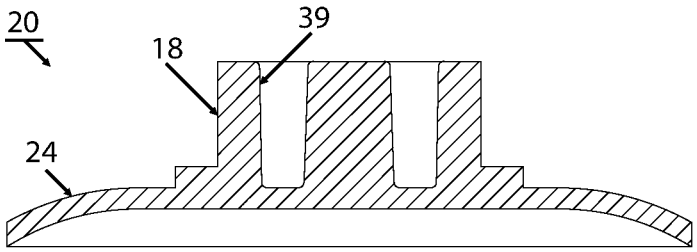

Turning now to FIG. 6, there is shown in plan and sectional views, the lower capture element 20 which is integral with the central post 18 that has a diameter approximating that of the small loop 28 and about which the small loop 28 rotates. The central post 18 has an interior circular well 39 sized to receive the cylindrical body 34.

Figure 7:
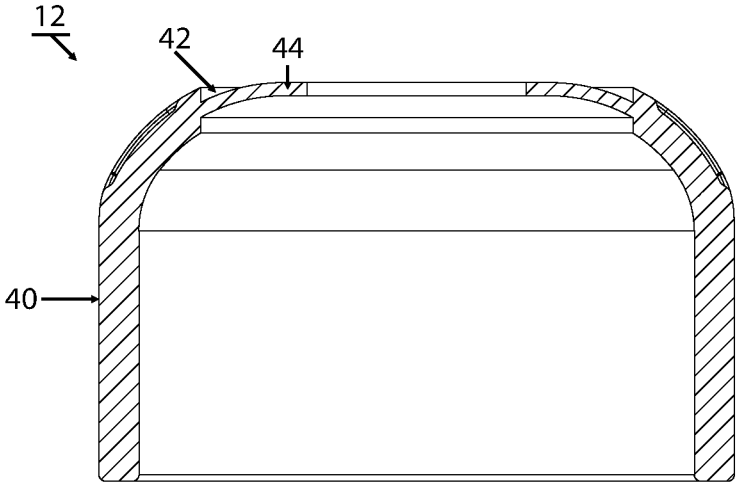
FIG. 7 is a side sectional view of the cap of FIG. 1 absent the tether capture assembly

Turning finally to FIG. 7, there is shown the cap 12 absent the tether capture assembly 16. The cap 12 is substantially cup-shaped with thicker walls 40. The top of the cap 42 has an indentation with thinner walls 44 that can be stretched to allow insertion and removal of the tether capture assembly 16.

In use, the upper capture disc 26 is placed over the post 18 where it rests adjacent the lower capture disc 24 to define an area into which the circumference of the cap 12 aperture can be held in place. The small loop 28 of the tether 14 is placed over the post portion 18 to rest on the upper surface of the upper capture disc 26. The cylindrical body 34 is then inserted into the circular well 39 of the lower capture element, thereby securing the tether 14 to the capture assembly 16.

In use with a bottle having a screw on top, the cap 12 is fitted over the bottle top and the large tether loop 30 is then fitted over the bottle neck. When the top is removed, the bottle can then be filled with a beverage of choice and the bottle top replaced. For subsequent use of the bottle, the cap 12 enables easy removal of the bottle top which is than permanently attached to the bottle by the tether 14, substantially reducing the risk of loss of the bottle top.

While the specification describes particular embodiments of the present invention, those of ordinary skill can devise variations of the present invention without departing from the inventive concept. Accordingly, the scope of the invention should only be limited by the scope of the claims appended below.

What is claimed as new is:

1. Apparatus for tethering a container cap to a container comprising in combination:

a. A cup shaped cap holder of elastomeric material including a central aperture;

b. a tether member including a first loop adapted to be mounted on the container and a second, smaller loop adapted to be connected to said cap holder;

c. a capture assembly including a lower capture disk adapted to support said cap holder interior through said central aperture and an upper capture disk adapted to support said cap holder on its outer surface; and d. a support post adapted to pass through said smaller loop and be connected to said lower capture disk whereby said cap holder is held between said capture disks but can be released therefrom by stretching said central aperture to escape said capture disks.

2. The apparatus of claim 1 wherein said small loop is held between said upper capture disk and said support post.

3. The apparatus of claim 1 wherein said support post includes a hollow cylinder and said lower capture disk includes a circular aperture sized to engage said cylinder.

4. A tether assembly for use with an elastomeric cap holder, comprising in combination;

a. a tether member including a first loop sized for mounting on a container and a second, smaller loop adapted to be connected to a cap holder b. a capture assembly including a lower capture disk, an upper capture disk and a support post adapted to pass through said smaller loop and be connected to said lower capture disk.

5. The apparatus of claim 4 wherein said small loop is held between said upper capture disk and said support post.

6. The apparatus of claim 4 wherein said support post includes a hollow cylinder and said lower capture disk includes a circular aperture sized to engage said cylinder.

7. A tether assembly for use with an elastomeric cap holder, comprising in combination;

a. A tether having at one end a small loop and, at the other end a large loop, said large loop being adapted to couple to a container whose cap is to be retained and said small loop adapted to be held by a capture assembly; and b. A capture assembly comprising an upper capture disc, a post having an enlarged head and hollow cylindrical body for capturing said small loop between said head and said upper capture disk, and a lower capture disk having a circular bore adapted to receive said cylinder, whereby the cap holder is provided with a central aperture sized to be smaller in diameter than said capture disks so that when stretched, said central aperture can be inserted between said capture disks or removed therefrom.

* * * * *